US010544793B2

(12) United States Patent
Zatorski et al.

(10) Patent No.: US 10,544,793 B2
(45) Date of Patent: Jan. 28, 2020

(54) THERMAL ISOLATION STRUCTURE FOR ROTATING TURBINE FRAME

(71) Applicant: General Electric Company, Schenectady, NY (US)

(72) Inventors: Darek Tomasz Zatorski, Fort Wright, KY (US); Brandon Wayne Miller, Liberty Township, OH (US); Richard Wesling, Cincinnati, OH (US); Gert Johannes van der Merwe, Lebanon, OH (US)

(73) Assignee: General Electric Company, Schenectady, NY (US)

( * ) Notice: Subject to any disclaimer, the term of this patent is extended or adjusted under 35 U.S.C. 154(b) by 259 days.

(21) Appl. No.: 15/415,164

(22) Filed: Jan. 25, 2017

(65) Prior Publication Data

US 2018/0209274 A1 Jul. 26, 2018

(51) Int. Cl.

| | |
|---|---|
| ***F04D 29/00*** | (2006.01) |
| ***F04D 29/053*** | (2006.01) |
| ***F01D 5/18*** | (2006.01) |
| ***F01D 11/16*** | (2006.01) |
| ***F01D 25/12*** | (2006.01) |

(52) U.S. Cl.

CPC ..... *F04D 29/053* (2013.01); *F01D 5/188* (2013.01); *F01D 11/16* (2013.01); *F01D 25/12* (2013.01); *F05D 2250/75* (2013.01); *F05D 2260/201* (2013.01); *F05D 2260/205* (2013.01)

(58) Field of Classification Search

CPC ..... F01D 5/188; F01D 25/12; F01D 11/16; F05D 2260/201; F05D 2260/205; F05D 2250/75; F04D 29/053

USPC ..... 415/139

See application file for complete search history.

(56) References Cited

U.S. PATENT DOCUMENTS

| | | | |
|---|---|---|---|
| 3,034,298 | A | 5/1962 | White |
| 3,903,690 | A | 9/1975 | Jones |
| 4,704,862 | A | 11/1987 | Dennison et al. |
| 4,860,537 | A | 8/1989 | Taylor |
| 6,164,656 | A | 12/2000 | Frost |
| 6,330,995 | B1 | 12/2001 | Mangeiga et al. |
| 6,431,820 | B1 | 8/2002 | Beacock et al. |
| 6,546,713 | B1 | 4/2003 | Hidaka et al. |

(Continued)

OTHER PUBLICATIONS

International Search Report and Written Opinion issued in connection with corresponding PCT Application No. PCT/US2017/061011 dated Feb. 22, 2018.

*Primary Examiner* — Mahmoud Gimie
(74) *Attorney, Agent, or Firm* — Dority & Manning, P.A.

(57) ABSTRACT

The present disclosure is directed to a gas turbine engine defining a radial direction, a circumferential direction, an axial centerline along a longitudinal direction, and wherein the gas turbine engine defines an upstream end and a downstream end along the longitudinal direction. The gas turbine engine includes a first turbine rotor comprising an inner shroud, an outer shroud outward of the inner shroud in the radial direction, at least one connecting airfoil coupling the inner shroud and the outer shroud at least partially along the radial direction, and an outer band outward of the outer shroud in the radial direction and extended at least partially in the circumferential direction, and a plurality of connecting members couples the outer shroud and the outer band.

20 Claims, 7 Drawing Sheets

(56) References Cited

U.S. PATENT DOCUMENTS

| | | | | |
|---|---|---|---|---|
| 6,666,017 | B2 | 12/2003 | Prentice et al. | |
| 6,883,303 | B1 | 4/2005 | Seda | |
| 7,296,398 | B2 | 11/2007 | Moniz et al. | |
| 7,882,693 | B2 | 2/2011 | Schilling | |
| 8,128,339 | B2 | 3/2012 | Kondo et al. | |
| 8,365,510 | B2 | 2/2013 | Lugg | |
| 8,667,775 | B1 | 3/2014 | Kisska et al. | |
| 8,733,693 | B2 | 5/2014 | Journade et al. | |
| 8,926,270 | B2 | 1/2015 | Karafillis et al. | |
| 9,103,227 | B2 | 8/2015 | Kupratis et al. | |
| 9,328,630 | B2 | 5/2016 | Brochard et al. | |
| 9,494,077 | B2 | 11/2016 | Chanez et al. | |
| 2007/0122266 | A1* | 5/2007 | Cairo | F01D 5/284 415/134 |
| 2010/0089019 | A1 | 4/2010 | Knight et al. | |
| 2014/0227088 | A1 | 8/2014 | Beaujard et al. | |
| 2015/0003978 | A1 | 1/2015 | Watanabe | |
| 2015/0226075 | A1 | 8/2015 | Aoli et al. | |
| 2016/0069260 | A1 | 3/2016 | Speak et al. | |
| 2016/0102607 | A1 | 4/2016 | Hiernaux | |
| 2016/0201510 | A1 | 7/2016 | Roach et al. | |

* cited by examiner

THERMAL ISOLATION STRUCTURE FOR ROTATING TURBINE FRAME

FIELD

The present subject matter relates generally to gas turbine engine architecture. More particularly, the present subject matter relates to a turbine section for gas turbine engines.

BACKGROUND

Gas turbine engines generally include a turbine section downstream of a combustion section that is rotatable with a compressor section to rotate and operate the gas turbine engine to generate power, such as propulsive thrust. General gas turbine engine design criteria often include conflicting criteria that must be balanced or compromised, including increasing fuel efficiency, operational efficiency, and/or power output while maintaining or reducing weight, part count, and/or packaging (i.e. axial and/or radial dimensions of the engine).

Interdigitated turbine sections are known to take advantage of relatively high fluid velocities between sequential stages of rotating airfoils without vanes therebetween. However, known interdigitated turbine sections are limited to interdigitated a low pressure turbine rotor and an intermediate pressure turbine rotor. Still further, known interdigitated turbine sections are limited by axial, radial, thermal, and/or mechanical loads from the inner radii of the interdigitated turbine sections, which may limit a quantity of stages that may be included in an interdigitated first turbine rotor.

Therefore, there exists a need for a structure that may reduce or remove limits to interdigitated first turbine rotor size and structural life due to axial, radial, thermal, and/or mechanical loads.

BRIEF DESCRIPTION

Aspects and advantages of the invention will be set forth in part in the following description, or may be obvious from the description, or may be learned through practice of the invention.

The present disclosure is directed to a gas turbine engine defining a radial direction, a circumferential direction, an axial centerline along a longitudinal direction, and wherein the gas turbine engine defines an upstream end and a downstream end along the longitudinal direction. The gas turbine engine includes a first turbine rotor comprising an inner shroud, an outer shroud outward of the inner shroud in the radial direction, at least one connecting airfoil coupling the inner shroud and the outer shroud at least partially along the radial direction, and an outer band outward of the outer shroud in the radial direction and extended at least partially in the circumferential direction, and a plurality of connecting members couples the outer shroud and the outer band.

In one embodiment, the connecting members of the first turbine rotor extend at least partially tangential from the outer shroud to the outer band.

In another embodiment, the connecting members define a first end proximate to the outer shroud, a second end proximate to the outer band, and a middle portion therebetween. At least one connecting member defines a first thickness and a second thickness, the first thickness disposed at about the first end and/or second end, and the second thickness disposed at about the middle portion.

In yet another embodiment, the connecting members define a first end proximate to the outer shroud, a second end proximate to the outer band, and a middle portion therebetween. At least one connecting member defines a serpentine structure at about the middle portion.

In still another embodiment, the outer band defines an annular ring generally concentric about the axial centerline.

In one embodiment, the outer shroud defines a platform extended at least partially along the longitudinal direction and at least partially along the circumferential direction, and the connecting members extend from the platform to the outer band.

In another embodiment, the outer band defines one or more balance planes along a portion of an inner diameter and/or along a portion of an outer diameter.

In yet another embodiment, the outer shroud and the outer band together define a secondary flowpath therebetween along the radial direction.

In still another embodiment, the one or more connecting airfoils, the inner shroud, and the outer shroud together define an integral structure.

In yet still another embodiment, the one or more connecting airfoils, the inner shroud, the outer shroud, the plurality of connecting members and the outer band together define an integral structure.

In various embodiments, the turbine section further includes a plurality of outer shroud airfoils extended inward of the outer shroud along the radial direction. In one embodiment, the turbine section further includes a plurality of inner shroud airfoils extended outward along the radial direction from the inner shroud. In still various embodiments, the engine further includes a second turbine rotor upstream of the one or more connecting airfoils of the first turbine rotor along the longitudinal direction, in which the second turbine rotor includes a plurality of second turbine airfoils extended outward in the radial direction. In one embodiment, the first turbine rotor and the second turbine rotor are interdigitated among one another. In another embodiment, the engine defines, in serial flow arrangement from the upstream end to the downstream end, the plurality of outer shroud airfoils of the first turbine rotor, the plurality of second airfoils of the second turbine rotor, and the one or more connecting airfoils of the first turbine rotor. In still another embodiment, the engine defines, in serial flow arrangement from the upstream end to the downstream end, the plurality of outer shroud airfoils of the first turbine rotor, the plurality of second airfoils of the second turbine rotor, the one or more connecting airfoils of the first turbine rotor, and a plurality of inner shroud airfoils extended outward along the radial direction from the inner shroud.

In various other embodiments, the first turbine rotor defines at least one rotating stage including the outer shroud, the inner shroud, the connecting airfoils, the outer band, and the connecting members. In one embodiment, the first turbine rotor defines the outer shroud, the inner shroud, the connecting airfoils, and the thermal isolation structure as at least one stage.

In another embodiment, the first turbine rotor defines at least one stage of a plurality of outer shroud airfoils extended inward from the outer shroud along the radial direction, and at least one stage of a plurality of inner shroud airfoils extended outward from the inner shroud along the radial direction.

In still another embodiment, the engine further includes a fan assembly comprising a plurality of blades, and a first shaft extended along the longitudinal direction, in which the first turbine rotor is coupled to and rotatable with the first shaft.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
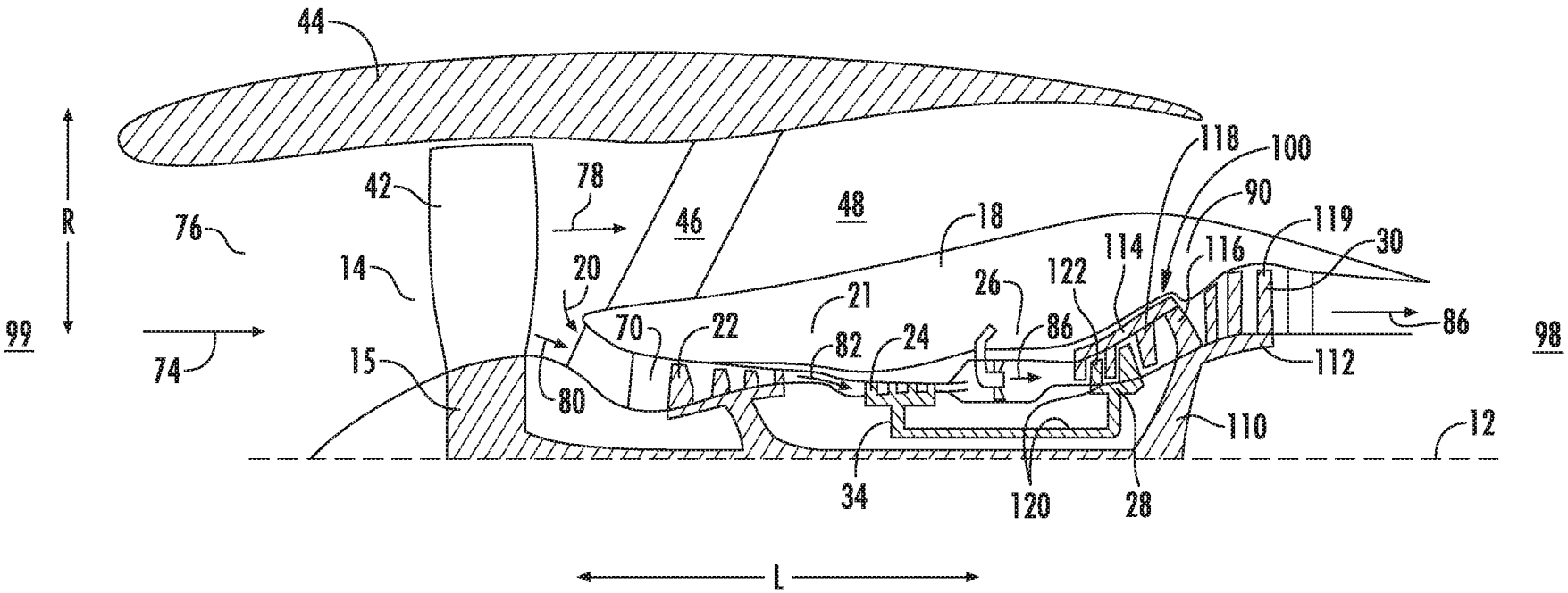
FIG. 1 is a schematic cross sectional view of an exemplary gas turbine engine incorporating an exemplary embodiment of a turbine section according to an aspect of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows. Unless otherwise stated, "downstream" and "upstream" refer to the general direction of fluid flow of air or resulting combustion gases through a core flowpath of the engine from entry into a compressor section through exit from a turbine section.

Various embodiments of a thermal isolation structure for a first turbine rotor for a gas turbine engine are generally provided. The first turbine rotor including the thermal isolation structure includes an inner shroud, an outer shroud outward of the inner shroud in the radial direction, and at least one connecting airfoil coupling the inner shroud and the outer shroud at least partially along the radial direction. The first turbine rotor further includes an outer band outward of the outer shroud in the radial direction and extended at least partially in the circumferential direction. A plurality of connecting members couples the outer shroud and the outer band.

The connecting members of the thermal isolation structure may transfer axial, radial, and/or thermal loads from the inner shroud, the connecting airfoils, and/or the outer shroud and through to the outer band. The outer band may define a structural support ring to which torque and/or thermal loads transfer from the inner shroud, the connecting airfoils, and/or the outer shroud. In still various embodiments, the connecting members may attenuate the high temperature gradient within a secondary flowpath defined between the outer shroud and the outer band. In various embodiments, the thermal isolation structure, including the connecting members from the outer shroud to the outer band, may transfer thermal, axial, radial, and mechanical loads to the outer band while providing adequate radial stiffness to support an overhung or cantilevered first turbine rotor for the interdigitated turbine section. Still further, the outer band may provide sufficient stiffness to attenuate undesired vibratory modes, harmonics, or noise and/or generally promote desired engine dynamics.

The interdigitated turbine section may increase fuel efficiency, operational efficiency, and/or power output while reducing weight, part count, and/or packaging (e.g. radial and/or axial dimensions). For example, the interdigitated turbine section may enable increased bypass ratio and/or overall pressure ratio of the gas turbine engine, thereby increasing fuel efficiency, operational efficiency, and/or power output relative to other engines of similar power output and/or packaging. The interdigitated turbine section may further reduce stationary and/or rotating airfoil quantities, and thereby engine packaging and/or weight, while maintaining or improving efficiencies, performance, or power output. Still further, the interdigitated turbine section may reduce a product of axial flow area and the square of the rotational speed (the product referred to as "$AN^2$") while additionally reducing an average work factor per stage of the turbine section.

Referring now to the drawings, FIG. 1 is a schematic cross sectional view of an exemplary gas turbine engine 10 (herein referred to as "engine 10"), shown as a high bypass turbofan engine, incorporating an exemplary embodiment of a turbine section 90 according to an aspect of the present disclosure. Although further described below with reference to a turbofan engine, the present disclosure is also applicable to turbomachinery in general, including propfan, turbojet, turboprop, and turboshaft gas turbine engines, including marine and industrial turbine engines and auxiliary power units. As shown in FIG. 1, the engine 10 has a longitudinal or axial centerline axis 12 that extends there through for reference purposes. The engine 10 defines a longitudinal direction L, a radial direction R, an upstream end 99 and a downstream end 98 along the longitudinal direction L, and a circumferential direction C (shown in FIGS. 3-4).

In general, the engine 10 may include a substantially tubular outer casing 18 that defines an annular inlet 20. The outer casing 18 encases or at least partially flows, in serial flow arrangement along the longitudinal direction L, a compressor section 21, a combustion section 26, and an interdigitated turbine section 90 (herein referred to as "turbine section 90"). A fan assembly 14 is disposed generally forward or upstream 99 of the compressor section 21. In the embodiment shown in FIG. 1, the engine 10 defines a two-spool configuration in which the compressor section 21 includes a first compressor 22 and a second compressor 24 in serial arrangement along the longitudinal direction L. The fan assembly 14 and the first compressor 22 are coupled to a first shaft 36 toward the upstream end 99 of the engine 10 and a first turbine rotor 110 is coupled to the first shaft 36 toward the downstream end 98 of the engine 10. The first compressor 22 and fan assembly 14 are driven by the first turbine rotor 110. The second compressor 24 is coupled to a second shaft 34 and a second turbine rotor 120 is coupled to the second shaft 34 toward the downstream end 98 of the engine 10. The second compressor 24 is driven by the second turbine rotor 120. In various embodiments, the first compressor 22 defines a low pressure (LP) compressor and the second compressor 24 defines a high pressure (HP) compressor. In still various embodiments, the first turbine rotor 110 may define an LP turbine 30 and the second turbine rotor 120 may define an HP turbine 28.

In other embodiments, the engine 10 may define a three-spool configuration in which the compressor section 21 defines a fan assembly 14 including a fan rotor 15, and the first compressor 22 and the second compressor 24. A third turbine rotor may define an IP turbine driving the first compressor 22 defining an IP compressor. The first turbine rotor 110 defining the LP turbine 30 is attached to the fan rotor 15, thus driving the fan assembly 14. In such an embodiment, the third turbine rotor may be disposed in interdigitation among the first turbine rotor 110 in addition to or in lieu of the second turbine rotor 120 defining the HP turbine 28.

Referring back to FIG. 1, the fan assembly 14 includes at least one stage of a plurality of fan blades 42 coupled to the fan rotor 15. The plurality of fan blades 42 are coupled to and extend outwardly from the fan rotor 15 in the radial direction R. In various embodiments, the fan rotor 15 may include a plurality of stages of fan blades 42 along the longitudinal direction L. An annular fan casing or nacelle 44 circumferentially surrounds at least a portion of the fan assembly 14 and/or at least a portion of the outer casing 18. In one embodiment, the nacelle 44 may be supported relative to the outer casing 18 by a plurality of circumferentially-spaced outlet guide vanes or struts 46. At least a portion of the nacelle 44 may extend over an outer portion (in radial direction R) of the outer casing 18 so as to define a bypass airflow passage 48 therebetween.

In other embodiments, the fan assembly 14 may further include a power or reduction gearbox disposed between the fan rotor 15 and a first shaft 36 coupled to the turbine section 90. The gearbox may reduce the rotational speed of the fan rotor 15 relative to the turbine rotor of the turbine section 90 to which the fan rotor 15 is attached via the first shaft 36.

Figure 2:
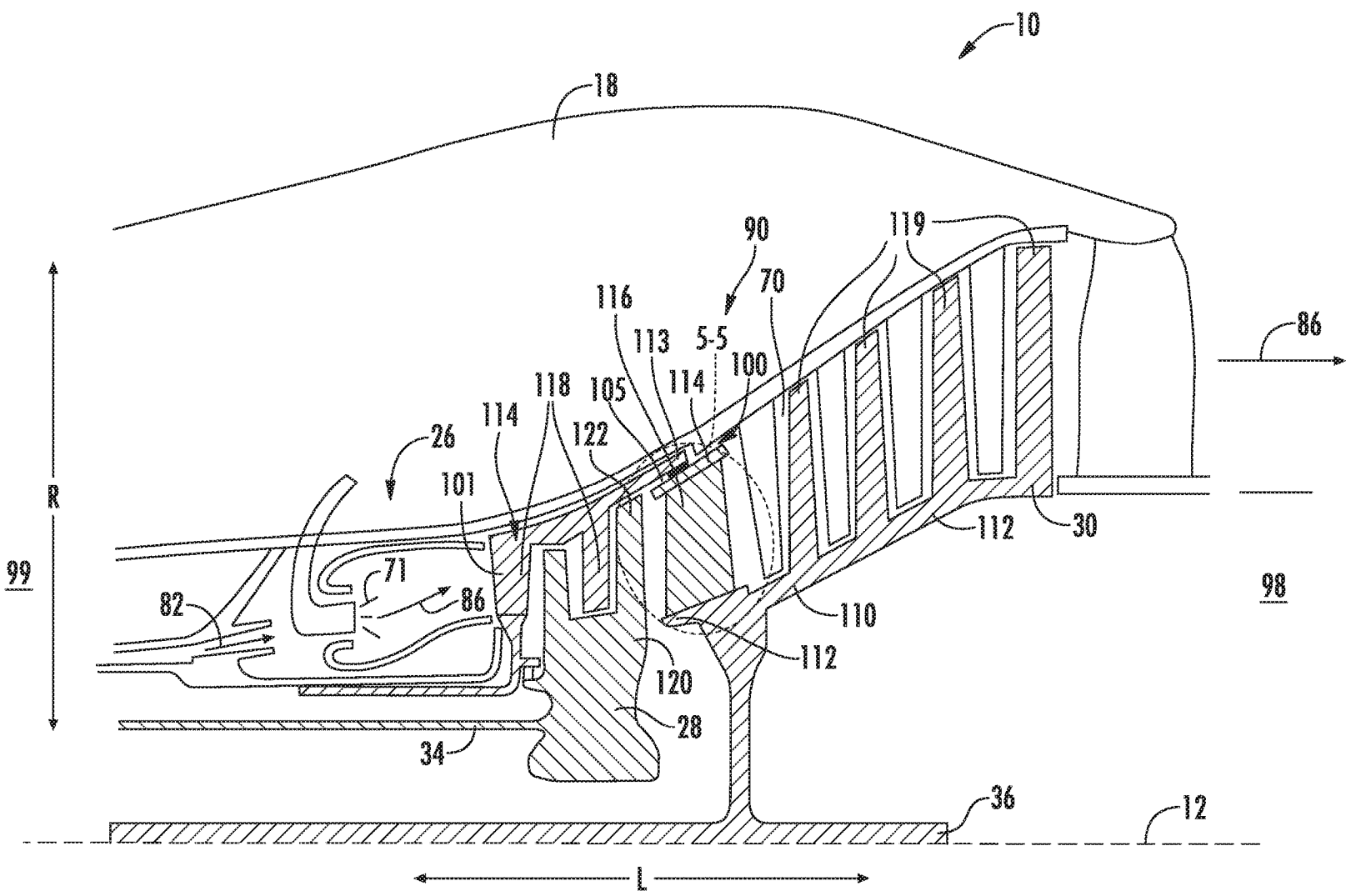
FIG. 2 is a schematic cross sectional view of an embodiment of the turbine section shown in FIG. 1.

Referring now to FIG. 2, an exemplary embodiment of the turbine section 90 of the engine 10 is generally provided. The turbine section 90 includes a first turbine rotor 110 extended along the longitudinal direction L. The first turbine rotor 110 includes an inner shroud 112, an outer shroud 114, and at least one connecting airfoil 116 coupling the inner shroud 112 to the outer shroud 114. The outer shroud 114 includes a plurality of outer shroud airfoils 118 extended inward along the radial direction R. In various embodiments, the inner shroud 112 may include a plurality of inner shroud airfoils 119 extended outward along the radial direction R.

The inner shroud 112 and the outer shroud 114 each extend generally along the longitudinal direction L. The inner shroud 112 and/or the outer shroud 114 may each extend at least partially in the radial direction R. In various embodiments, the inner shroud 112 extends from the connecting airfoil 116 toward the downstream end 98 along the longitudinal direction L. In other embodiments, the outer shroud 114 extends from the connecting airfoil 116 toward the upstream end 99 along the longitudinal direction L toward the combustion section 26.

Referring still to FIG. 2, the turbine section 90 may further include a second turbine rotor 120 disposed forward or upstream 99 of the one or more connecting airfoils 116 of the first turbine rotor 110. The second turbine rotor 120 includes a plurality of second airfoils 122 extended outward along the radial direction R. In various embodiments, the second turbine rotor 120 is disposed forward or upstream 99 of the connecting airfoils 116 and in interdigitation with the first turbine rotor 110. For example, as shown in FIG. 1, the engine 10 and turbine section 90 may define, in serial flow arrangement from the upstream end 99 to the downstream end 98, the plurality of outer shroud airfoils 118 of the first turbine rotor 110, the plurality of second airfoils 122 of the second turbine rotor 120, the one or more connecting airfoils 116 of the first turbine rotor 110, and one or more stages of the plurality of inner shroud airfoils 119. In various embodiments, the turbine section 90 may define a plurality of iterations of the plurality of outer shroud airfoils 118 alternating with the plurality of second airfoils 122 along the longitudinal direction L. In one embodiment, the first turbine rotor 110 may define between one and ten rotating stages, inclusively. For example, the first turbine rotor 110 may define the outer shroud 114, the inner shroud 112, the connecting airfoils 116, and a thermal isolation structure 100 (shown in FIGS. 3-5) as at least one stage. In another embodiment, the first turbine rotor 110 may define between three and ten rotating stages, inclusively. In one embodiment, the second turbine rotor 120 may define at least one rotating stage in interdigitation with the first turbine rotor 110.

Although not shown in FIG. 1, the engine 10 may further include a third turbine rotor coupled to and rotatable independently of the second turbine rotor 120 and in interdigitation with the first turbine rotor 110. Although not depicted in FIG. 1, it should be understood that one or more rotating stages of the second turbine rotor 120 depicted herein may alternatively be defined as the third turbine rotor driving a third compressor in the engine 10.

Referring back to FIGS. 1-2, during operation of the engine 10 a volume of air as indicated schematically by arrows 74 enters the engine 10 through an associated inlet 76 of the nacelle and/or fan assembly 14. As the air 74 passes across the fan blades 42, a portion of the air as indicated schematically by arrows 78 is directed or routed into the bypass airflow passage 48 while another portion of the air as indicated schematically by arrows 80 is directed through the fan assembly 14 and through the inlet 20. The air 80 is progressively compressed as it flows through the compressor section 21 toward the combustion section 26.

The now compressed air, as indicated schematically by arrows 82, flows into the combustion section 26 where a fuel is introduced, mixed with at least a portion of the compressed air 82, and ignited to form combustion gases 86. The combustion gases 86 flow into the turbine section 90, causing the first and second turbine rotors 110, 120, and in various embodiments, the third turbine rotor, of the turbine section 90 to rotate and support operation of respectively coupled rotary members in the compressor section 21 and/or fan assembly 14.

Figure 3:
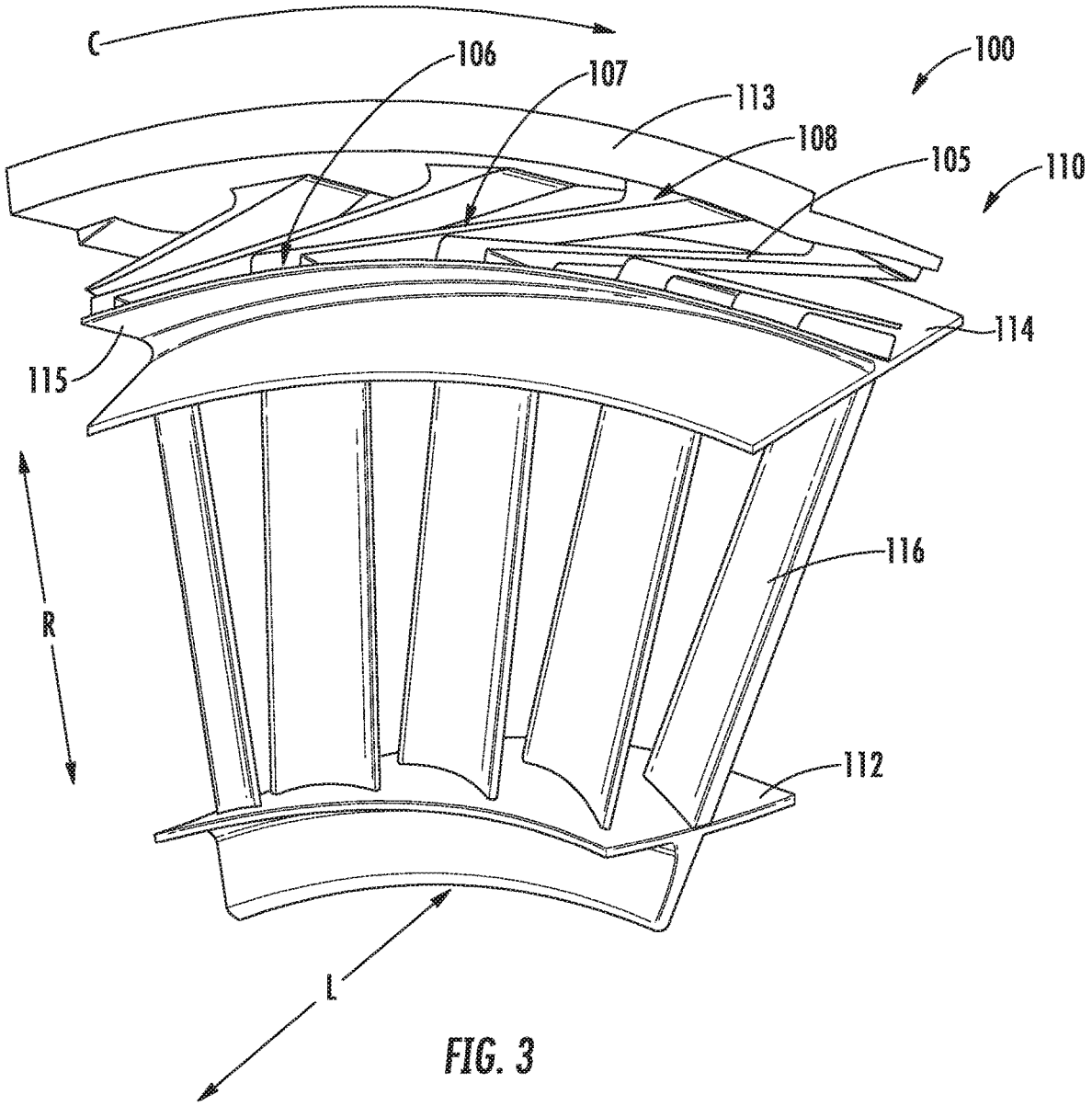
FIG. 3 is a perspective view of an exemplary embodiment of a first turbine rotor.
Figure 4:
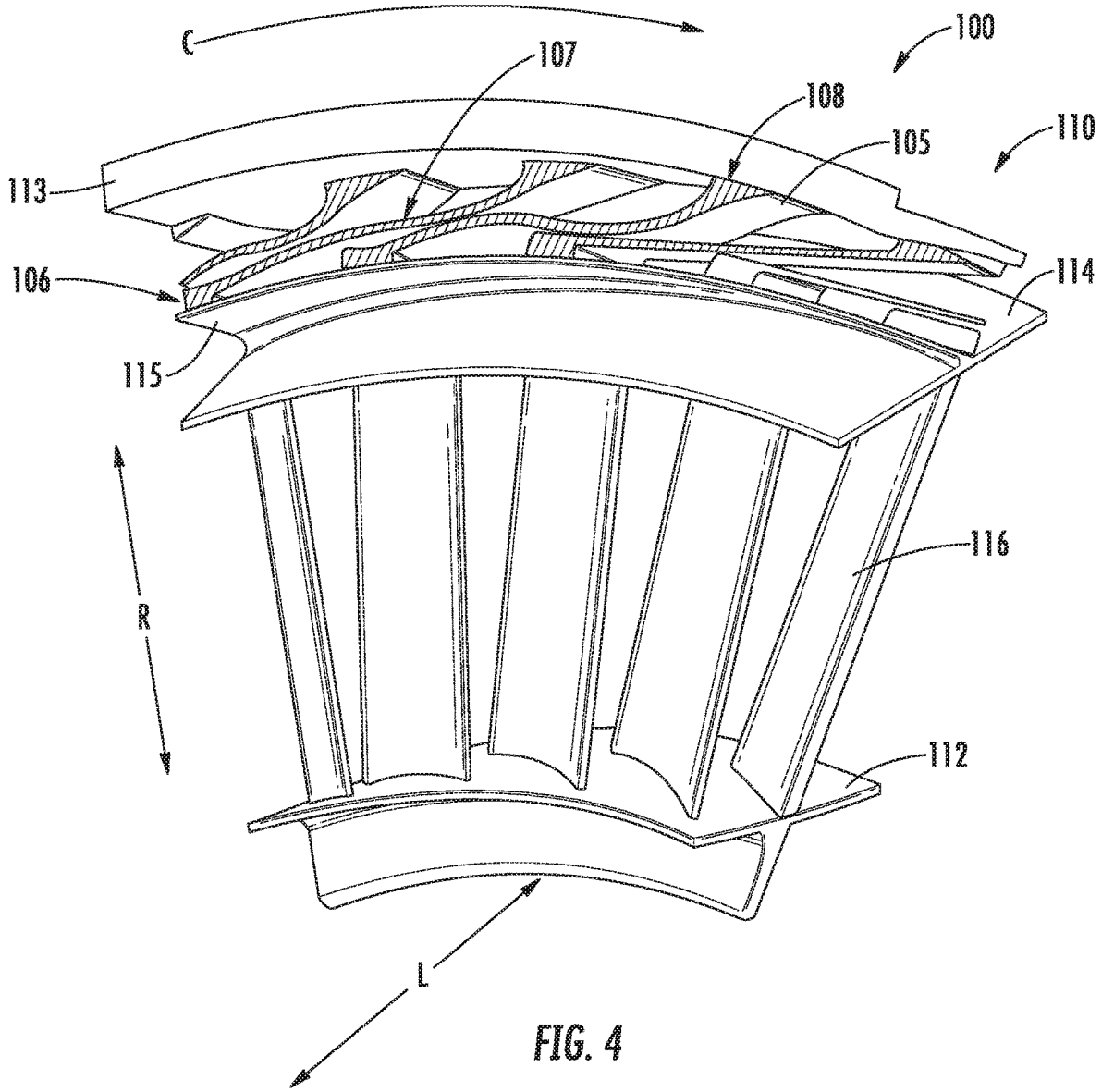
FIG. 4 is a perspective view of another exemplary embodiment of a first turbine rotor.

Referring now to FIGS. 3 and 4, exemplary embodiments of a portion of a thermal isolation structure 100 on the first turbine rotor 110 are generally provided. The first turbine rotor 110 includes an inner shroud 112 and an outer shroud 114 outward of the inner shroud 112 in the radial direction R. At least one connecting airfoil 116 couples the inner shroud 112 and the outer shroud 114 at least partially in the radial direction R. The first turbine rotor 110 further includes an outer band 113 outward of the outer shroud 114 in the radial direction R. The outer band 113 is extended at least partially in the circumferential direction C. A plurality of connecting members 105 couples the outer shroud 114 and the outer band 113.

The thermal isolation structure 100 generally includes the plurality of connecting members 105 coupled to the outer shroud 114 and the outer band 113. The thermal isolation structure 100 may transfer thermal and mechanical loads, such as loads along the axial or longitudinal direction L, loads along the radial direction R, and/or twisting, bending, vibrational, or torsional loads along the longitudinal direction L, the radial direction R, and/or the circumferential direction C. The connecting members 105 may attenuate high temperature gradients in a secondary flowpath 69 defined between the outer shroud 114 and the outer band 113 along the radial direction R. The thermal isolation structure including the connecting members 105 and the outer band 113 may together define a structural support for the first turbine rotor 110 that may enable an overhung or cantilevered outer shroud 114. The thermal isolation structure 100 may further enable interdigitation of the first turbine rotor 110 with the second turbine rotor 120 that may improve turbine section 90 performance and/or efficiency, engine 10 performance, operability, and/or efficiency, and/or reduce weight, part count, and/or packaging (e.g. longitudinal and/or radial dimensions) of the engine 10. In various embodiments, the thermal isolation structure 100 may enable interdigitation of additional stages, such as forward of the second turbine rotor 120 defining a high pressure (HP) turbine. In still various embodiments, the thermal isolation structure 100 may provide structural support enabling the overhung or cantilevered outer shroud 114 and the inner shroud 112 extended at least partially in an opposite direction along the longitudinal direction L.

Referring still to FIGS. 3 and 4, the connecting members 105 may extend at least partially tangentially from the outer shroud 114 to the outer band 113. Each connecting member 105 may define a first end 106 proximate or adjacent to the outer shroud 114 (e.g. along an outer diameter of the outer shroud 114). Each connecting member 105 may further define a second end 108 proximate or adjacent to the outer band 113 (e.g. along an inner diameter of the outer band 113). Each connecting member 105 may further define a middle portion 107 between the first end 106 and the second end 108.

In various embodiments, one or more of the connecting members 105 may define various thicknesses. For example, one or more of the connecting members 105 may define a first thickness disposed at about the first end 106 and/or the second end 108 and a second thickness disposed within at least a portion of the middle portion 107 therebetween. In another example, the middle portion 107 of one or more of the connecting members 105 may increase and/or decrease in thickness between the first end 106 and the second end 108. In still another example, each connecting member 105 may define different or alternating thicknesses between the first end 106 and the second end 108. In various embodiments, a plurality of thicknesses or definitions may be employed to attenuate of the thermal gradient along the secondary flowpath 69, attenuate undesired vibratory modes, promote structural rigidity or flexibility as desired, and/or promote structural support for the first turbine rotor 110 in interdigitation with the second turbine rotor 120. Still further, the outer band 113 and/or the connecting members 105 may provide sufficient stiffness to attenuate undesired vibratory modes, harmonics, or noise and/or generally promote desired engine dynamics.

In the embodiment shown in FIG. 3, the connecting members 105 extend generally straight along a generally tangential direction from the outer shroud 114 to the outer band 113. In the embodiment shown in FIG. 4, the connecting members 105 at least partially define a serpentine structure. For example, the serpentine structure may define a waveform in the middle portion 107 of one or more of the connecting members 105. Referring to FIGS. 3 and 4, in one embodiment, the thermal isolation structure 100 of the first turbine rotor 110 may define a plurality of connecting members 105 defining combinations of generally straight and partially serpentine middle portions 107. For example, the thermal isolation structure 100 may define an alternating combination of generally straight and serpentine middle portions 107. As another example, the thermal isolation structure 100 may define an alternating combination of generally straight and serpentine middle portions 107, and alternating combinations of various thicknesses of middle portions 107.

Figure 5:
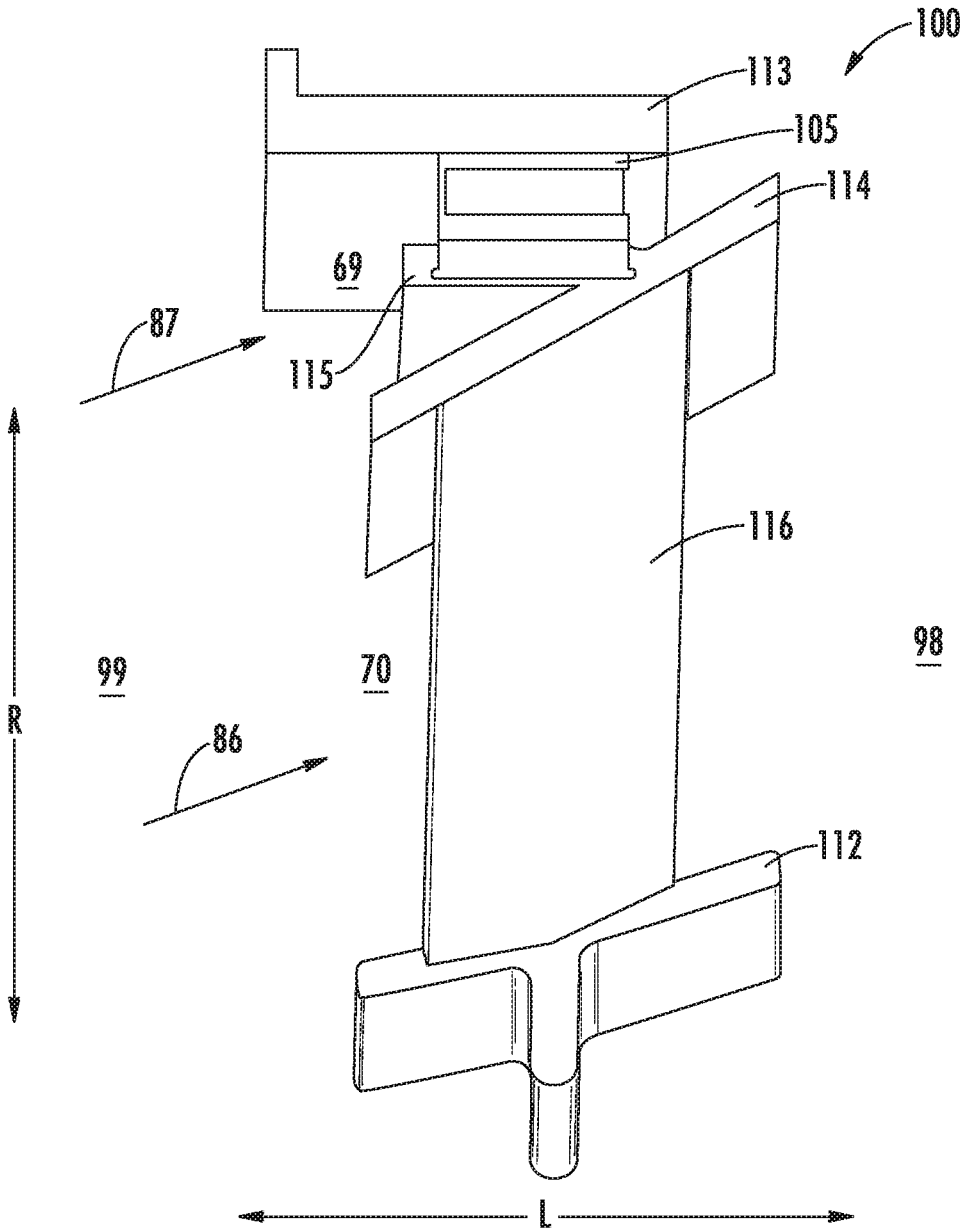
FIG. 5 is a side view of an exemplary embodiment of a first turbine rotor.
Figure 6:
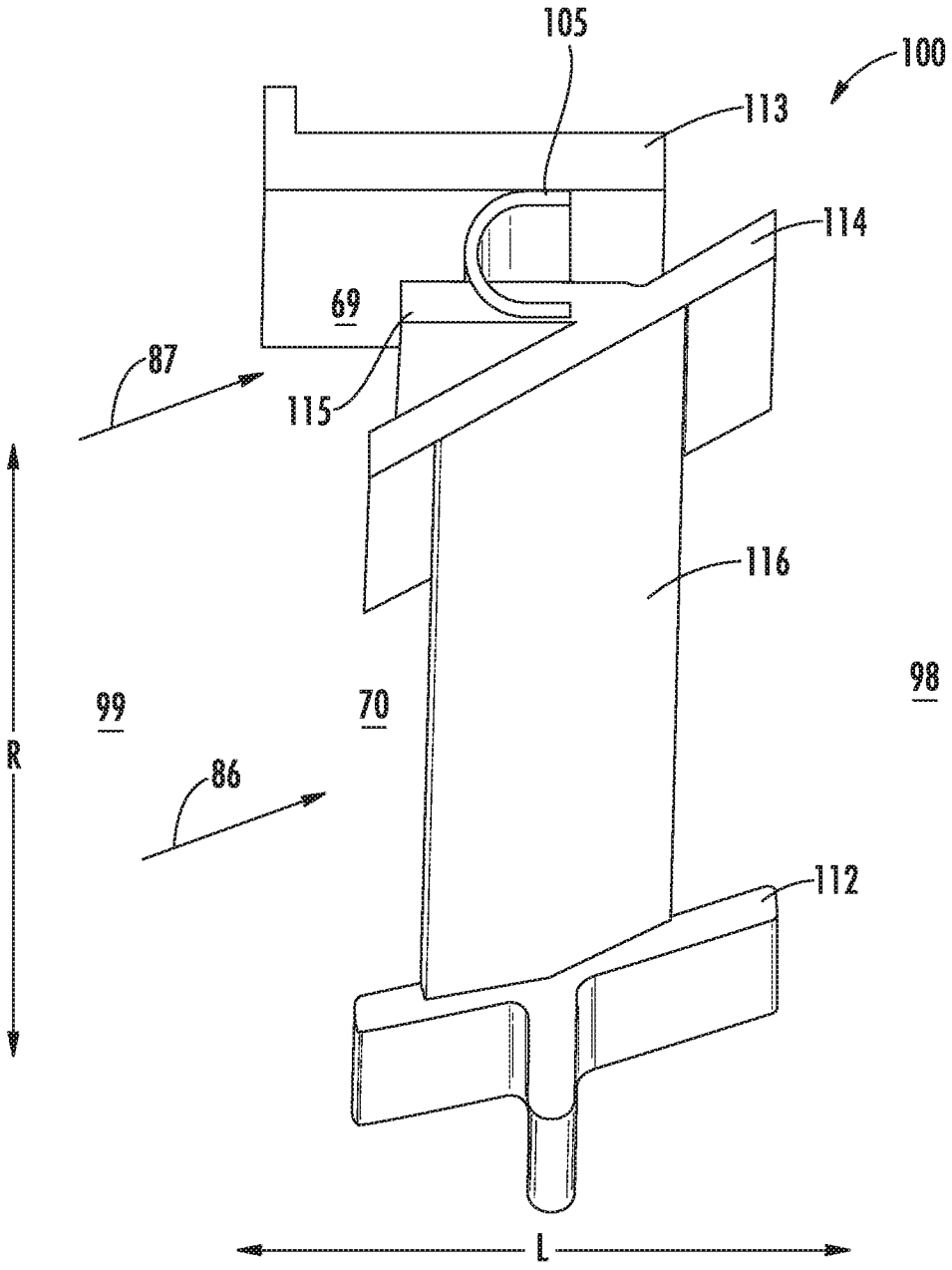
FIG. 6 is a side view of another exemplary embodiment of a first turbine rotor.
Figure 7:
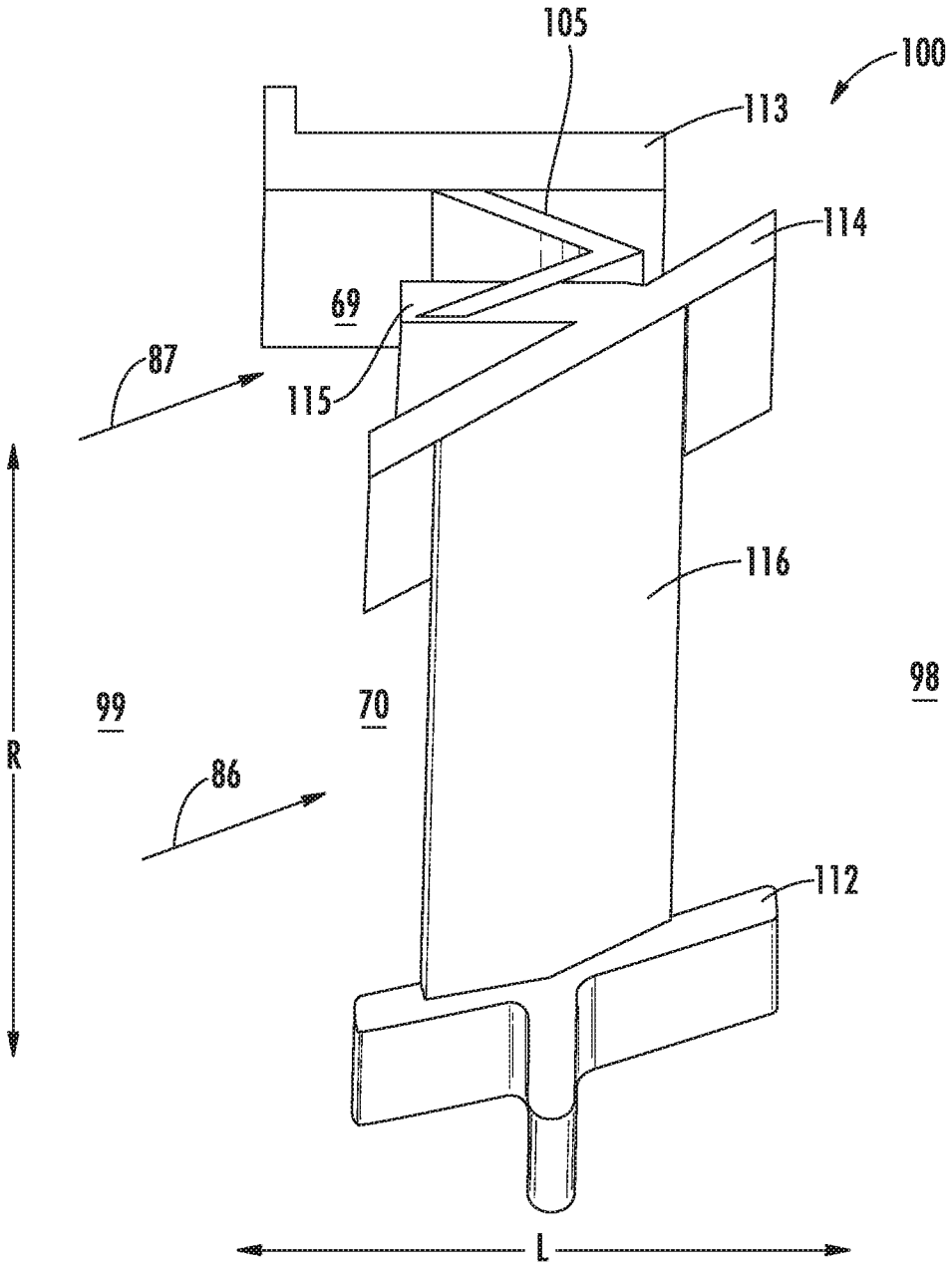
FIG. 7 is a side view of yet another exemplary embodiment of a first turbine rotor.

FIGS. 5-7 each provide exemplary embodiments of a side view along the longitudinal direction L of the first turbine rotor 110 including the thermal isolation structure 100. Referring to FIGS. 3-7, the outer shroud 114 may further define a platform 115 extended at least partially along the longitudinal direction L (as shown in FIGS. 5-7) and at least partially along the circumferential direction C (as shown in FIGS. 3-4). The connecting members 105 extend from the platform 115 to the outer band 113. In various embodiments, the platform 115 may define a wall extended generally concentric and generally parallel with the outer band 113. The generally concentric and generally parallel platform 115 may provide a surface from or against which the connecting members 105 transfer force or torque substantially along the radial direction R.

Referring to the exemplary embodiment of the thermal isolation structure 100 shown in FIG. 6, the connecting members 105 may generally define a "C" cross section. The connecting member 105 may define springing properties, e.g., compressing or tensioning at least along the radial direction R. Referring to the exemplary embodiment of the thermal isolation structure 100 shown in FIG. 7, the connecting members 105 may generally define a spring (e.g., a zig-zag cross section such as shown in FIG. 7).

Referring now to FIGS. 3-7, in various embodiments the outer band 113 may define an annular ring generally concentric about the axial centerline 12 of the engine 10 (shown in FIG. 1). In one embodiment, the outer band 113 defines a solid annular ring. The outer band 113 may define strength and material properties for absorbing mechanical and thermal loads from the inner shroud 112, the connecting airfoils 116, the outer band 114, and the connecting members 105. In another embodiment, the outer band 113 defines a segmented ring in which a plurality of segments are adhered together via mechanical fasteners, such as, but not limited to, bolts, nuts, nut plates, screws, rivets, or pins, or one or more joining processes, such as welding, soldering, or brazing.

In still various embodiments, the outer band 113 may define one or more balance planes, such as along a portion of an inner diameter (i.e. within the secondary flowpath 69) and/or along a portion of an outer diameter. For example, the outer band 113 may define one or more locations onto which a weight is adhered (e.g. mechanical fasteners, joining processes, or retention clip) onto the outer band 113 to achieve a desired static and/or dynamic balance of the outer band 113 and/or the first turbine rotor 110. As another example, the outer band 113 may define one or more locations from which material may be removed to achieve a desired static and/or dynamic balance of the outer band 113 and/or the first turbine rotor 110.

Referring still to FIGS. 3-5, at least a portion of the thermal isolation structure 100 and/or first turbine rotor 110 may define an integrally formed structure. The structure may be formed of various processes, such as, but not limited to, additive manufacturing or 3D printing. The integrally formed structure may additionally, or alternatively, include one or more casting, forging, and/or machining processes. In one embodiment, the one or more connecting airfoils 116, the inner shroud 112, and the outer shroud 114 may together define an integral structure. In another embodiment, the one or more connecting airfoils 116, the inner shroud 112, the outer shroud 114, the plurality of connecting members 105, and the outer band 113 together define an integral structure. In still other embodiments, one or more of the connecting airfoils 116, the inner shroud 112, the outer shroud 114, the connecting members 105, and/or the outer band 113 may be adhered to one another via one or more mechanical fasteners and/or joining processes, independently of or in conjunction with one or more integrally defined structures.

The turbine section 90, including the thermal isolation structure 100, the first turbine rotor 110, the second turbine rotor 120, or individual stages thereof, may be formed of ceramic matrix composite (CMC) materials and/or metals appropriate for gas turbine engine hot sections, such as, but not limited to, nickel-based alloys, cobalt-based alloys, iron-based alloys, or titanium-based alloys, each of which may include, but are not limited to, chromium, cobalt, tungsten, tantalum, molybdenum, and/or rhenium. The turbine section 90, or portions or combinations of portions thereof, may be formed using additive manufacturing or 3D printing, or casting, forging, machining, or castings formed of 3D printed molds, or combinations thereof. The turbine section 90, or portions thereof, may be mechanically joined using fasteners, such as nuts, bolts, screws, pins, or rivets, or using joining methods, such as welding, bonding, friction or diffusion bonding, etc., or combinations of fasteners and/or joining methods. The first turbine rotor 110 and/or the second turbine rotor 120, including individual stages thereof, may be constructed as individual blades installed into drums or hubs, or integrally bladed rotors (IBRs) or bladed disks, or combinations thereof.

The turbine section 90 shown and described herein may improve upon existing turbine sections by providing improved fuel efficiency, operational efficiency, and/or power output while maintaining or reducing weight, part count, and/or packaging. The plurality of outer shroud airfoils 118 interdigitated among the second turbine rotor(s) 120 may reduce packaging and reduce part count by removing stages of stationary airfoils between each rotating component. Additionally, the turbine section 90 may provide efficiency benefits comparable to a reduction gearbox without adding weight or size (e.g. axial length) to the engine 10. The first turbine rotor 110, as a first stage downstream of the combustion section 26, may further improve engine efficiency by removing design constraints to the combustion section 26 that may account for combustor hot spots. Furthermore, the turbine section 90 may improve engine 10 efficiency by reducing requirements for cooling air, generally extracted from the compressor section 21 and often considered to remove potential propulsive energy from the engine 10.

Still further, the thermal isolation structure 100 including the outer band 113 and the connecting members 105, may provide structural support responsive to axial, radial, torsional, thermal, or other mechanical loads that may enable an overhung or cantilevered outer shroud 114 interdigitated with a plurality of stages of the second turbine rotor 120. Furthermore, the structural support of the thermal isolation structure 100 may enable the outer shroud 114 to overhang forward or upstream of the second turbine rotor 120 defining a HP turbine. Alternatively, the thermal isolation structure 100 may enable the outer shroud 114 to overhang forward or upstream to dispose the plurality of outer shroud airfoils 118 immediately downstream of the combustion section 26 (i.e. in lieu of a first turbine vane or nozzle).

In various embodiments, the thermal isolation structure 100 may enable the first turbine rotor 110 to define at least one rotating stage. In one embodiment, the first turbine rotor 110 may define a single stage including the outer shroud 114, the inner shroud 112, the connecting airfoils 116, the outer band 113, and the connecting members 105. In another embodiment, the first turbine rotor 110 may define at least 2 stages of airfoils, including a stage of the connecting airfoils 116, one or more stages of the outer shroud airfoils 118. In still another embodiment, the first turbine rotor 110 may define at least 3 stages of airfoils, including a stage of the connecting airfoils 116, one or more stages of the outer shroud airfoils 118, and one or more stages of the inner shroud airfoils 119. In various embodiments, the thermal isolation structure 100 provides thermal gradient attenuation, thereby mitigating deleterious effects of the gases 87 within the secondary flowpath 69.

The systems shown in FIGS. 1-5 and described herein may decrease fuel consumption, increase operability, increase engine performance and/or power output while maintaining or reducing weight, part count, and/or packaging (e.g. radial and/or axial dimensions). The systems provided herein may allow for increased bypass ratios and/or overall pressure ratios over existing gas turbine engine configurations, such as turbofans, while maintaining or reducing packaging relative to other gas turbine engines of similar power output. The systems described herein may contribute to improved bypass ratio and/or overall pressure ratio and thereby increase overall gas turbine engine efficiency. The systems provided herein may increase overall gas turbine engine efficiency by reducing or eliminating stationary airfoils that require cooling air (e.g. nozzle guide vane). Additionally, the systems provided herein may reduce gas turbine engine packaging and weight, thus increasing efficiency, by reducing rotating and/or stationary airfoil quantities (e.g. blades and/or vanes).

Still further, the systems shown in FIGS. 1-5 and described herein may reduce a product of a flow area and the square of the rotational speed (the product herein referred to as "$AN^2$") of the gas turbine engine. For example, engine 10 shown and described in regard to FIGS. 1-5 may generally reduce $AN^2$ relative to a conventional geared turbofan configuration. Generally, lowering the $AN^2$, such as by reducing the rotational speed and/or the flow area, increases the required average stage work factor (i.e. the average required loading on each stage of rotating airfoils). However, the systems described herein may lower the $AN^2$ while also lowering the average stage work factor and maintaining axial length of the turbine section 90 (compared to engines of similar thrust output and packaging) by interdigitating the first rotating component 110 among the one or more stages of the second rotating component 120 while also defining a non-digitated turbine structure (i.e. the inner shroud 112 and the plurality of inner shroud airfoils 119) toward the downstream end 98 of the turbine section 90. Therefore, the first rotating component 110 may increase the quantity of rotating stages of airfoils while reducing the average stage work factor, and therefore the $AN^2$, while mitigating increases in axial length to produce a similar $AN^2$ value. The first rotating component 110 may further reduce the $AN^2$ while additionally reducing the overall quantity of airfoils, rotating and stationary, in the turbine section 90 relative to turbine sections of gas turbine engines of similar power output and/or packaging.

Furthermore, the systems shown in FIGS. 1-5 and described herein may further improve engine efficiency, reduce airfoil quantity, reduce engine weight, and/or alleviate combustion section design constraints by interdigitating the first rotating component 110 forward or upstream 99 of the second rotating component 120 defining the high speed turbine 28. For example, defining the first stage of the first rotating component 110 as immediately downstream 98 of the combustion section 26, without a first turbine vane or nozzle guide vane therebetween, as well as defining the first rotating component 110 in counter-rotation with the second rotating component 120, may reduce effects of overall combustion hot spots on the first stage of the first rotating component 110 in contrast to a stationary, first turbine vane or nozzle guide vane. As such, the turbine section 90 and engine 10 described herein may remove constraints to combustion section 26 design by de-emphasizing hot spots, or combustion pattern factor, in favor of other design criteria, such as decreasing emissions, improving lean blow-out (LBO) and/or altitude re-light, improving overall operability across part or all of an operating envelope, or increasing the operating envelope.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gas turbine engine, wherein the gas turbine engine defines a radial direction, a circumferential direction, an axial centerline along a longitudinal direction, and wherein the gas turbine engine defines an upstream end and a downstream end along the longitudinal direction, the gas turbine engine comprising:

a first turbine rotor comprising an inner shroud, an outer shroud outward of the inner shroud in the radial direction, at least one connecting airfoil coupling the inner shroud and the outer shroud at least partially along the radial direction, and an outer band outward of the outer shroud in the radial direction and extended at least partially in the circumferential direction, and further wherein a plurality of connecting members couples the outer shroud and the outer band.

2. The gas turbine engine of claim 1, wherein the connecting members of the first turbine rotor extend at least partially tangential from the outer shroud to the outer band.

3. The gas turbine engine of claim 1, wherein the connecting members define a first end proximate to the outer shroud, a second end proximate to the outer band, and a middle portion therebetween, and wherein at least one connecting member defines a first thickness and a second thickness, the first thickness disposed at about the first end and/or second end, and the second thickness disposed at about the middle portion.

4. The gas turbine engine of claim 1, wherein the connecting members define a first end proximate to the outer shroud, a second end proximate to the outer band, and a middle portion therebetween, and wherein at least one connecting member defines a serpentine structure at about the middle portion.

5. The gas turbine engine of claim 1, wherein the outer band defines an annular ring generally concentric about the axial centerline.

6. The gas turbine engine of claim 1, wherein the outer shroud defines a platform extended at least partially along the longitudinal direction and at least partially along the circumferential direction, and wherein the connecting members extend from the platform to the outer band.

7. The gas turbine engine of claim 1, wherein the outer band defines one or more balance planes along a portion of an inner diameter and/or along a portion of an outer diameter.

8. The gas turbine engine of claim 1, wherein the outer shroud and the outer band together define a secondary flowpath therebetween along the radial direction.

9. The gas turbine engine of claim 1, wherein the one or more connecting airfoils, the inner shroud, and the outer shroud together define an integral structure.

10. The gas turbine engine of claim 1, wherein the one or more connecting airfoils, the inner shroud, the outer shroud, the plurality of connecting members and the outer band together define an integral structure.

11. The gas turbine engine of claim 1, wherein the first turbine rotor further comprises a plurality of outer shroud airfoils extended inward of the outer shroud along the radial direction.

12. The gas turbine engine of claim 11, wherein the first turbine rotor further comprises a plurality of inner shroud airfoils extended outward along the radial direction from the inner shroud.

13. The gas turbine engine of claim 11, the engine further comprising:

a second turbine rotor upstream of the one or more connecting airfoils of the first turbine rotor along the longitudinal direction, wherein the second turbine rotor includes a plurality of second turbine airfoils extended outward in the radial direction.

14. The gas turbine engine of claim 13, wherein the first turbine rotor and the second turbine rotor are interdigitated among one another.

15. The gas turbine engine of claim 13, wherein the engine defines, in serial flow arrangement from the upstream end to the downstream end, the plurality of outer shroud airfoils of the first turbine rotor, the plurality of second airfoils of the second turbine rotor, and the one or more connecting airfoils of the first turbine rotor.

16. The gas turbine engine of claim 13, wherein the engine defines, in serial flow arrangement from the upstream end to the downstream end, the plurality of outer shroud airfoils of the first turbine rotor, the plurality of second airfoils of the second turbine rotor, the one or more connecting airfoils of the first turbine rotor, and a plurality of inner shroud airfoils extended outward along the radial direction from the inner shroud.

17. The gas turbine engine of claim 1, wherein the first turbine rotor defines at least one rotating stage including the outer shroud, the inner shroud, the connecting airfoils, the outer band, and the connecting members.

18. The gas turbine engine of claim 17, wherein the first turbine rotor defines the outer shroud, the inner shroud, the connecting airfoils, and a thermal isolation structure as at least one stage, wherein the thermal isolation structure comprises the outer band and the connecting members coupled to the outer band and the outer shroud.

19. The gas turbine engine of claim 1, wherein the first turbine rotor defines at least one stage of a plurality of outer shroud airfoils extended inward from the outer shroud along the radial direction, and at least one stage of a plurality of inner shroud airfoils extended outward from the inner shroud along the radial direction.

20. The gas turbine engine of claim 1, the engine further comprising:

a fan assembly comprising a plurality of blades; and a first shaft extended along the longitudinal direction, wherein the first turbine rotor is coupled to and rotatable with the first shaft.

* * * * *